US005514192A

United States Patent [19]

Grigsby, Jr.

[11] Patent Number: 5,514,192

[45] Date of Patent: May 7, 1996

[54] PLASTIC STONEWASHING STONE AND METHOD

[76] Inventor: Jerry L. Grigsby, Jr., 504 S. Main St., Malvern, Ark. 72104

[21] Appl. No.: 15,554

[22] Filed: Feb. 9, 1993

[51] Int. Cl.[6] ..... B24D 3/00

[52] U.S. Cl. ..... 51/296; 51/307; 264/41; 264/54; 264/211; 521/154; 521/159

[58] Field of Search ..... 51/293, 295, 307, 51/296, 306; 521/154, 159; 264/41, 54, 211

[56] References Cited

U.S. PATENT DOCUMENTS 4,436,679 3/1984 Winstead ..... 264/54
4,904,280 2/1990 Cygan et al. ..... 51/307
4,954,138 9/1990 Butcher et al. ..... 51/293
5,266,087 11/1993 Oat ..... 51/309

*Primary Examiner*—Deborah Jones
*Attorney, Agent, or Firm*—Browning, Bushman, Anderson & Brookhart

[57] ABSTRACT

A porous and abrasive plastic stone is disclosed for use in a stonewashing process to commercially age garments or fabric. The plastic stone replaces the pumice stone that is typically used in the stonewashing process. A method for manufacturing the stone includes mixing plastic material with a gas-producing agent within a plastic extruder. This produces a plurality of cells or voids in the plastic as gas expands during the cooling of the plastic. The cells along the periphery of the plastic material are ruptured by the gas to form an abrasive surface comparable to that of pumice and yield a plastic stone with a desired density.

15 Claims, 1 Drawing Sheet

PLASTIC STONEWASHING STONE AND METHOD

BACKGROUND OF THE INVENTION

1. Field of the Invention

The present invention relates to an improved stonewashing stone and to methods for making and using a preferred plastic stone. More specifically, the present invention is directed to a durable plastic stone useful in a garment stonewashing process having a density and abrasiveness approximating that of pumice stone.

2. Description of the Background

In recent years, fabric having an aged appearance has experienced a significant increase in value. An exemplary fabric processed to have an aged appearance is denim. Various methods have been developed for commercial processing of denim to produce this effect. Typically, these commercial processes involve abrading the fabric with a pumice stone, either natural or manmade from pumice granules.

The stonewashing process consists of several distinct operations that occur after loading the fabric or garment into a washing machine. The first operation is typically that of desizing. Sizing, or unwanted filling in the fabric, is removed with desizing chemicals. Desizing agents such as amylase enzyme, caustic soda and peroxide, or other desizing agents are added to the bath for this purpose. The desizing agents break down the sizing that often includes waxes or starches. If not for the desizing step, the sizing might come between the cotton fibers to insulate the cotton fibers from chemicals used in subsequent steps of the stonewashing process.

The second step is normally the abrading step that gives the garment an aged appearance. Over time, the mechanical action from even a standard washing machine will abrade the fabric sufficiently to produce an aged appearance. However, for commercial feasibility in producing the aged look, normal washing requires too much energy and time.

It has been known for some time that the use of pumice rock is especially effective for abrading denim. It produces a substantially uniform aged look and speeds up the process to save time and energy. The pumice rock and the garments tumble against each other in the rotating washing cylinder. Chemical agents, such as cellulase enzyme, are also presently used for producing the aged look. Often the steps of washing, tumbling with pumice rock, and adding enzymes are combined. The desired aged appearance effect is thereby obtained at a relatively low cost.

A conventional step in the stonewashing process produces the preferred shade, contrast, and feel. This step frequently utilizes a series of applications of chemicals, such as chlorine bleach, oxygen bleach, and optical brighteners, to produce the desired characteristics.

While the use of pumice stone has been effective in the stonewashing process, pumice stone has several disadvantages. During the abrading process, pumice deteriorates rather quickly to produce sand and grit, i.e., pumice has a high attrition rate. The pumice grit also attacks the seals and bearings of the abrading or washing cylinders, causing increased downtime. Accumulating pumice in drains and sumps acts to create a significant odor that permeates the workplace, and the waste is costly to dispose of. Pumice usage indirectly causes environmental concerns because the mining of pumice stone typically damages the landscape.

Transportation, mining, and storage costs for the pumice add significant costs to the stonewashing process.

Due to the problems associated with pumice rock in the stonewashing process, other materials have been tested for use in place of pumice. These materials include broken stone, nuggets of metal, cement blocks, ceramic briquets, and hard plastics including polypropylene. While these materials have, in some instances, reduced attrition rates compared to pumice rock, they typically have other disadvantages. For instance, most of these products lack the desired density to produce uniform abrasion. Most of these materials produce damaging holes in the garments. The lighter materials, such as polypropylene briquets, do not produce significant abrasion within a reasonable time period, thereby increasing energy costs and reducing the efficiency of a stonewashing facility.

Consequently, a need exists for improvements in the stonewashing process. Efficiencies of time and energy require improvement in the abrading step that presently uses pumice stone. The output quality of the abrading process using pumice stone should be maintained, while damage to the environment should be limited. Working conditions at fabric stonewashing facilities may be improved, and inventory and shipping costs for the abrading material need to be lowered. Those skilled in the art have long sought and will appreciate the novel features of the present invention that solves most if not all of these problems.

SUMMARY OF THE INVENTION

The present invention is directed to a high porosity, highly abrasive plastic stone for stonewashing garments, and to methods for making and using such a stone. The present invention and method utilize plastic as the abrading material. The plastic is processed to produce an improved artificial stonewashing stone that has highly desirable and long-sought characteristics.

The artificial stone is preferably made in a process that is similar to the natural process by which pumice stone is made. It has been known for centuries that the highly porous interior and highly abrasive exterior of pumice stone is created by the extreme puffing up (vesiculation) of liquid lava by expanding gases liberated from solution in the lava before and during solidification.

The preferred method of manufacturing the plastic stone includes a step of combining and heating a plastic material with a gas-producing agent to form a heated plastic mixture. As the mixture cools, gasses liberated from the gas-producing agent expand to produce voids or cells within the plastic material. The expanding gas ruptures the cells on the outer surfaces of the plastic mixture to produce a highly abrasive surface for the plastic stone. That is to say, an external surface, of at least some of the voids or cells, ruptures or bursts to form a highly abrasive surface. While injection molding could be used to make the plastic stone of the present invention, it would be difficult to produce as rough a surface as that obtained by rupturing cells on the outer surfaces.

In a preferred embodiment, a plastic extruder combines and heats the plastic mixture. The plastic material is extruded through a circular aperture in the output key of the plastic extruder. Thus, the extruded plastic is substantially cylindrical in shape, and its desired length may be easily obtained. The plastic used in the process may be scrap plastic. Thus, the process effectively recycles scrap plastic to prevent the plastic from becoming an environmental waste product.

Soda and citric acid may be used as gas-producing agents and are mixed with the plastic granules prior to heating. For consistency, plastic pellets are coated with an adhesive agent, such as mineral oil. Talc may be added as nucleating element to form cells from the expanding gas.

The highly porous and highly abrasive artificial stone is used in a stonewashing process similar to or substantially the same as the process that uses pumice stone as the abrading material. However, the lifespan of a preferred artificial stone in this process is much longer than the life of pumice rock.

After the artificial plastic stone is worn to a small size, it may be recycled to reduce waste products of the stonewashing process. Alternatively, the plastic may be continuously worn while new plastic stone is added, and the small stone thereafter either manually or automatically removed.

An object of the present invention is to form an artificial stonewashing stone having a density and abrasiveness similar to that of pumice stone. The artificial stone is formed of a plastic material for improved characteristics.

A feature of the present invention is effectiveness in the abrading process largely equivalent to that of pumice rock.

A further feature is the inclusion of a gas-producing agent mixed with polystyrene pellets to produce a gas when heated for forming the desired voids or cells in the artificial stone.

An advantage of the present invention is an improved attrition rate in the stonewashing process compared to pumice.

A further advantage of the present invention is the ability to recycle worn artificial stonewashing stones to reduce waste products.

These and other objects, features and intended advantages of the present invention will be readily apparent by the following detailed description, wherein reference is made to the figures in the accompanying drawings.

While the invention will be described in connection with the presently preferred embodiment, it will be understood that it is not intended to limit the invention to this embodiment. On the contrary, this disclosure may be used as the basis for claiming various alternatives, modifications and equivalents that are included within the invention.

DETAILED DESCRIPTION OF THE PREFERRED EMBODIMENTS

The present invention is directed to an improved artificial stonewashing stone and to methods for making and using such a stone. It is desirable that the plastic stone of this invention be made from a plastic material, and that the produced stone have a density of from 20 lbs/ft$^3$ to 50 lbs/ft$^3$, and more particularly from about 20 lbs/ft$^3$ to 25 lbs/ft$^3$.

It is also desirable that the artificial stonewashing stone of the present invention have a high porosity, typically higher than 25%, as does naturally occurring pumice stone. Porosity is generally defined as the volume of pore space in a material divided by the total volume of the rock. Porosity may range from about 20% to 40% with approximately 35% being a preferable value. During operation, the plastic material wears to expose internal cells or pore space and thereby produce additional rough, jagged, surfaces. Thus, the plastic stone, similarly to pumice stone, has a self-sharpening feature for maintaining abrasiveness throughout the stonewashing process. It is also desirable that the artificial stonewashing rock have an abrasive surface similar to that of pumice rock but be significantly more durable.

The artificial stone is formed from virgin or recycled plastic material, or more preferably a mixture of virgin/recycled material by weight of at least 7:10, and more preferably 5:2 (an increase of virgin material). The following are particularly suitable plastic materials for forming a stone according to this invention: polystyrene, polyethylene, PET, polypropylene, and ABS.

Figure 1:
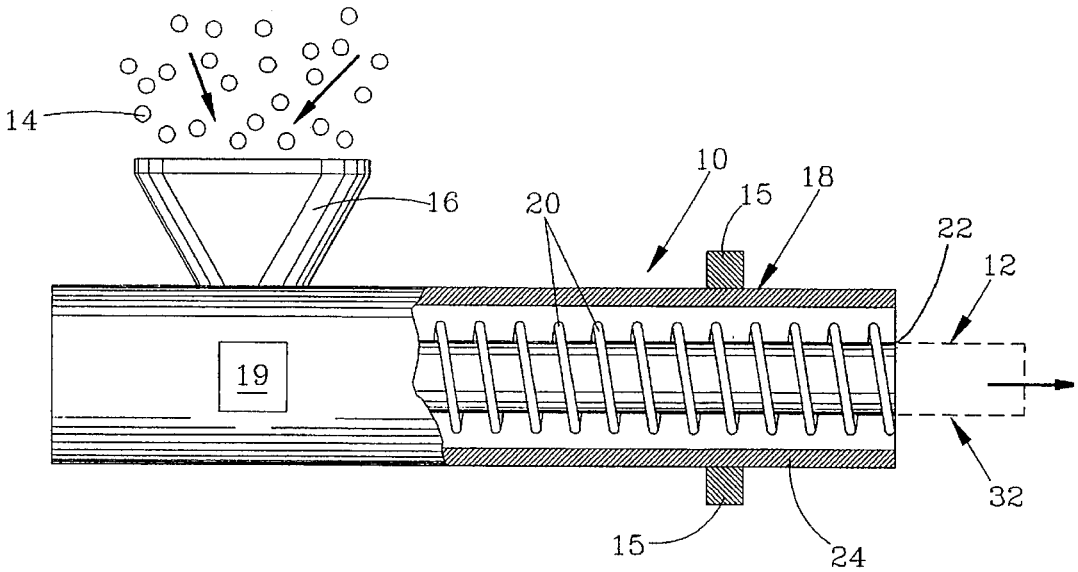
FIG. 1 is an elevational view, partially in section, of a simplistic portion of a plastic extruder used in accordance with the method of the present invention.
Figure 2:
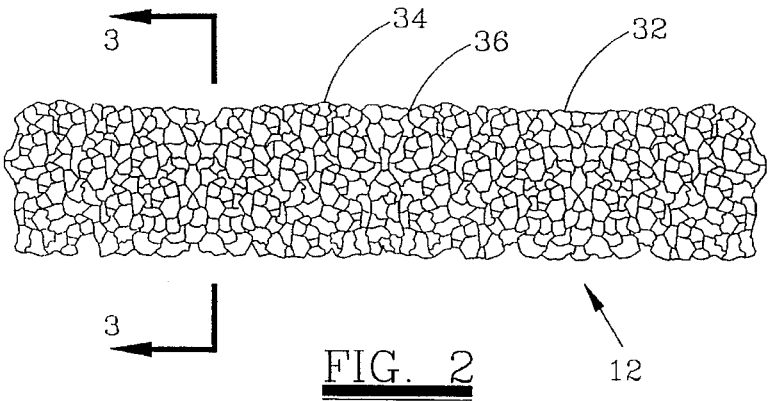
FIG. 2 is an elevational view of an exemplary artificial stonewashing stone in according to the present invention.

The artificial stonewashing rock of the present invention is fabricated in a manner similar to the creation of pumice rock in nature. Referring to FIG. 1, there is conceptually shown a plastic extruder 10 for extrusion mixing and heating of a plastic mixture to form the artificial stonewashing stone 12 of the present invention. In a preferred embodiment, plastic pellets 14 are added to extruder 10 via opening 16 in extruder housing 18. A mixer 19 may be provided as part of the extruder, or the material mixing operation may be formed by a mixer separate from the extruder. The housing 18 effectively forms a pressurized chamber for the heated plastic mixture, which mixture cools and returns to ambient pressure when extruded from the housing. Plastic pellets 14 are, more specifically, formed of polystyrene. However, various plastics and plastic resins may be used.

Pellets 14 may be formed of waste plastic, such as scrap or recycled polystyrene, to produce the artificial stonewashing stone 12 of the present invention. Thus, the invention has a positive effect on the environment. The recycled scrap plastic typically requires sorting, cleaning, separating, and granulating before heating in plastic extruder 10. The color of the final product depends on the color or colors of plastic pellets 14, and may be easily altered by conventional dyes.

Plastic pellets 14 are typically coated with an adhering agent, such as mineral oil, to hold the various ingredients, including gas producing agents and nucleating agents discussed hereinafter, together for uniform combination. While the adhering characteristics of mineral oil are preferable, other oils with the same or similar characteristics could also be used. Mineral oil is also compatible with the materials used in forming artificial stonewashing stone 12.

Bi-carbonate soda and citric acid are preferably used as a gas-producing agent that expands the molten plastic material to form large numbers of voids. The soda and citric acid combination produces gas in sufficient quantities for operation of the process of the present invention and are effective for this purpose at temperatures above approximately 200° F. While these gas-producing agents are chosen largely because of low cost and ease of use, other gas producing agents could be used. Blowing agents such as butane, freon, nitrogen, etc. may also be used. Blowing agents could, for instance, be introduced approximately halfway down extruder housing 18.

Figure 3:
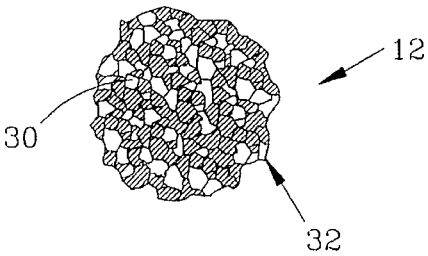
FIG. 3 is an elevational view, taken along lines 3—3 of FIG. 2, of a cross-section of an artificial stonewashing stone according to the present invention.

Talc adheres to the mineral oil and acts as a nucleating agent or nucleator to aid in forming the cells as gas from the gas-producing agents is generated in the heated plastic material within the extruder housing 18. The gas expands when released from the high pressure within housing 18 to substantially atmospheric pressure outside the extruder, and forms a cell or void such as cell 30 of FIG. 3. Talc is a porous material. Thus, as the gases are created by the soda and citrus mixture, cells are formed with talc forming the effective nucleus of the cell. While in extruder 10, the cells are under pressure. As the cells exit extruder 10 and are exposed to atmospheric pressure, the voids or cells increase in size, and may frequently rupture. Talc normally remains in the plastic stonewashing stone 12 until it is worn away by use. Less than 10% by weight, and more preferably 1–2% talc by weight, is typically used in the present invention for this purpose. Other materials of similar characteristics as talc could be used. For instance, Portland cement could be used for this purpose.

The combination of these elements, i.e., plastic granules, oil, talc, citric acid, and soda, are referred to hereinafter as a plastic mixture. In a preferred combination by weight, the plastic mixture contains 1–2% talc, 1–½% soda and citrus, 0.5% mineral oil, and 96% plastic. It is possible to change the density of the formed stone by changing the relative amounts of the additives. For instance, fewer units of plastic with more units of soda and citric acid may be used to decrease the density of artificial stone 12.

Referring to FIG. 1, the plastic mixture enters into extruder 10 via opening 16. After entering opening 16, threads or fluting 20 press the plastic mixture towards output key 22 as extruder rotor 24 rotates. As the plastic mixture moves toward output key 22, it is heated to a molten state. The rotation of extruder rotor 24 creates heat and further mixes the plastic mixture. The plastic mixture is expelled or extruded through output key 22 of extruder housing 18. The output key 22 typically includes a circular aperture with a diameter from 0.5 inches to 1.5 inches. This diameter effectively controls the diameter of the extruded plastic mixture. The artificial stonewashing stones are typically about 3" to 5" in length, and from ½" to 1½" in diameter, thus having a generally cylindrical shape.

Plastic extruder housing 18 includes temperature control apparatus 15, which may include temperature sensors, for controlling the temperature within extruder housing 18 to a desired and pre-selected range, typically from ambient temperature to about 450° F.

As known by those skilled in the art, various designs of the extruder rotor 24, internal size of extruder housing 18, diameter of output key 22, the viscosity of the plastic mixture, and other factors affect the temperature of the plastic mixture. Often extruders have from four to eight zones in which temperature may be controlled. The combination of these individual zone temperatures produce what may be referred to as a temperature profile. The most desirable temperatures for each zone may be determined from material specification sheets which show amount and flow of material, such as polystyrene, with respect to temperature.

For instance, using polystyrene, a preferred embodiment of the present invention utilizes a four zone extruder having a temperature profile such that in zone 1 the temperature is 185° F.; zone two has a temperature of 300° F.; zone 3 has a temperature of 400° F.; and zone 4 has a temperature of 450° F.

After the molten plastic mixture is extruded, it begins to cool in an ambient pressure/temperature environment. While it is cooling, the gasses created by the gas-producing agent expand to form cells within the plastic material. These cells may be seen in FIG. 3, which is a cross-section of artificial stonewashing stone 12 of the present invention. The cells or voids are numerous and are of varying size and shape. The average size of the cells or voids, such as cell or void 30, is approximately 2 mm and most voids are less than 5 mm. Preferably, about 80% of the void space includes voids greater than about 1 mm. The approximate range in size of voids for most of the volume of the stone is preferably from about 0.25 mm to about 5 mm. Larger cells may be created by using more gas. Temperature affects cell size to a lesser extent.

The process is extremely effective in creating many cells, thereby increasing the porosity of the plastic material and achieving the desired density. It will be understood by those skilled in the art, that varying the relative quantities of the components can affect the final porosity and/or density. Thus, varying the quantity of gas per unit plastic may produce a plastic stone having a density ranging from about 20 lbs/ft$^3$ to 50 lbs/ft$^3$. The quantity of gas may also be controlled to produce a plastic stone having a porosity in a range from about 20% up to 40%.

An additional reaction occurs along the surface 32 of the extruded plastic mixture. The cells along the surface are ruptured to form many jagged edges of a highly abrasive surface similar to that of pumice stone. The expanding gas from the gas producing agent literally explodes the cells or voids. The material or external surface surrounding at least some of the cells is ruptured to produce a jagged, abrasive surface. This surface has been likened to that of a corn cob. Cells internal to the stone as well as cells along the surface of the stone may be ruptured by the gas. The distance between average peaks and valleys, such as peak 34 and valley 36, on the surface are typically approximately 2 mm but may range up to about 6 mm or down to less than 0.25 mm. There may typically range from about 25 to over approximately 300 such peaks and valleys in one square inch of surface of artificial stone 12 of the present invention. The general abrasiveness or jaggedness is largely affected by the quantity of gas used or produced. While the surface may be comparable to a very course grade of sandpaper, it is not as uniform as sandpaper. The relative quantity of gas may therefore also be used to control the abrasiveness of the surface of artificial stone 12 so the peaks within a square inch of surface range from about 6 mm to less than 0.25 mm.

The hardness of the surface can be varied as desired by adding high density or low density polyethylene, rubber, or other components to the plastic mixture within extruder housing 18. The harder the artificial stone 12 is, the more abrasive it will typically be. However, harder artificial stones wear more quickly. Softer stones resist wear better but have decreased efficiency in the stone washing process of the present invention. If it is desired to alter the hardness of artificial stone 12, then a preferred embodiment may include 15–20% by weight higher or lower density polyethylene, plastic, or rubber to extruder housing 18. Thus, in certain cases, total plastic content by weight may be approximately 75%.

The artificial stonewashing stone 12 is used in the stonewashing process similarly to pumice rock. That is, artificial stone 12 is added to a washing machine or abrading machine cylinder with the fabric or garment to be processed. The cylinder or tumbler rotates either continuously or in a back and forth manner. The tumbler mounts vertically or horizontally depending on the preferred operation.

It has been found the time of abrasion using artificial stonewashing stone 12 is about the same or slightly greater than pumice rock. For instance, if the abrading process using pumice requires 30 minutes, then the abrading process using the artificial stonewashing stone 12 may take 35 minutes. Thus, satisfactory performance of artificial stone 12 in the stonewashing process may be achieved even if the surface of artificial stone 12 is somewhat less abrasive than that of pumice stone. The performance of plastic stone of the present invention may be compared with that of pumice stone by substituting the same volume of plastic stone for pumice stone in a wash formula with the measure of performance being a time comparison between the two mediums to achieve a specific level of abrasion.

However, there are significant advantages to using the artificial stonewashing stone as compared with the pumice stone. The plastic stone has a significantly lower rate of attrition than pumice. The artificial stone 12 typically lasts about 8.5 times longer than the same quantity of pumice stone. More generally, the attrition rate of artificial stonewashing stone 12 may range from about six to ten times less than that of pumice. It is believed the significant increase in durability of artificial stone 12 over pumice stone is due to the greater elasticity and bonding characteristics of plastic as compared to pumice stone. This feature of the invention results in many benefits, including lower costs, decreased filtering times, and less washing machine breakdown due to bearing problems.

After the artificial stonewashing stone 12 is eventually worn to a small size through use in the abrading step of stonewashing, it may be recycled to make a new artificial stonewashing stone. As noted earlier, the stone may be either automatically removed or manually picked from the other stone when its size limit is reached. The stone may also be used with other conventional abrasive materials, such as pumice stone, and this desired mixture then used in the stonewashing process.

The foregoing description of the invention has been directed in primary part to a particular, preferred embodiment in accordance with the requirements of the patent statutes and for purposes of illustration. It will be apparent to those skilled in the art that many modifications and changes in the specifically described preferred embodiments may be made without departing from the scope and spirit of the invention. Therefore, the invention is not restricted to the preferred embodiment illustrated but covers all modifications which may fall within the scope of the claims.

We claim:

1. A method of manufacturing a plastic stone useful for abrading fabric, comprising the steps of:

combining a plastic material and a gas-producing agent to form a mixture of plastic material and gas-producing agent;

heating the mixture of plastic material and gas-producing agent within a pressurized chamber of an extruder to form voids of gas within said heated plastic material from said gas-producing agent;

extruding the heated plastic material from the pressurized chamber to ambient pressure;

cooling said plastic material so that said voids within said plastic material achieve a density of from 20 lbs./1 cu. ft. to 50 lbs/cu. ft. for said plastic material, said voids of gas further rupturing an external surface of at least some of said voids to form an abrasive exterior surface on said plastic stone; and adjusting the quantity of said gas-producing agent to create peaks and valleys on said abrasive exterior surface of said plastic stone wherein the distance between said peaks and said valleys is, in an average range from less than 0.25 mm to about 6 mm.

2. The method as defined in claim 1, wherein said plastic material includes plastic pellets, and wherein said step of combining further comprises the steps of:

coating said plastic pellets with an adhering agent; and mixing said coated pellets with said gas-producing agent such that said gas-producing agent adheres to said coating.

3. The method as defined in claim 2, wherein the mixing step further comprises the step of:

combining talc with said altering agent.

4. The method as defined in claim 1, wherein said gas-producing agent is bicarbonate of soda and citric acid.

5. The method as defined in claim 1, further comprising the step of:

forming pellets of said plastic material from scrap plastic.

6. The method as defined in claim 1, further comprising:

varying the quantity of said gas-producing agent per unit of plastic material to produce a plastic stone having a density of from about 20 lbs/ft$^3$ to 50 lbs/ft$^3$.

7. The method as defined in claim 6, further comprising the step of:

controlling said quantity of said gas-producing agent while regulating the temperature during said heating step to produce a plastic stone having a porosity in the range from about 20% to 40%.

8. The method as defined in claim 1, further comprising the step of:

adjusting surface hardness of said abrasive exterior surface of said plastic stone by adding an elastomeric material to said plastic material, the elastomeric material being selected from a group consisting of polyethylene and rubber.

9. The method as defined in claim 1, wherein said plastic material is selected from a group consisting of polystyrene, polyethylene, PET, polypropylene, and ABS.

10. An artificial stone having a density greater than about 20 lbs./cu. ft., said artificial stone having a plastic material content greater than 75% of the total content by weight of said artificial stone, said artificial stone having voids therein such that said artificial stone has a porosity from 20% to 40%, at least some of said voids having a broken outer surface forming jagged edges and forming a broken exterior surface of said artificial stone.

11. The artificial stone as defined in claim 10, wherein said artificial stone has a density ranging from 20 lbs. /cu. ft. to 50 lbs/cu.ft.

12. The artificial stone as defined in claim 10, further comprising:

talc material in an amount less than about 1–2% of total weight of said artificial stone.

13. The artificial stone as defined in claim 10, wherein said exterior surface has peaks and valleys with a distance from said peaks to said valleys in the average range from less than 0.25 mm to approximately 6 mm.

14. The artificial stone as defined in claim 10, wherein said voids average less than 5 mm in diameter.

15. The artificial stone as defined in claim 10, wherein said artificial stone plastic material content includes recycled scrap plastic.

* * * * *

UNITED STATES PATENT AND TRADEMARK OFFICE

CERTIFICATE OF CORRECTION

PATENT NO. : 5,514,192

DATED : May 7, 1996

INVENTOR(S) : Jerry L. Grigsby, Jr.

It is certified that error appears in the above-indentified patent and that said Letters Patent is hereby corrected as shown below:

In column 8, line 12, change "altering" to --adhering--.

Signed and Sealed this

Eighth Day of October, 1996

*Attest:*

*Attesting Officer*

BRUCE LEHMAN

*Commissioner of Patents and Trademarks*